US007097219B2

(12) United States Patent
Paskonis

(10) Patent No.: US 7,097,219 B2
(45) Date of Patent: Aug. 29, 2006

(54) ENCAPSULATED STRIKER ASSEMBLY

(75) Inventor: Almantas K. Paskonis, Concord, OH (US)

(73) Assignee: Anchor Tool & Die Company, Cleveland, OH (US)

( * ) Notice: Subject to any disclaimer, the term of this patent is extended or adjusted under 35 U.S.C. 154(b) by 451 days.

(21) Appl. No.: 10/138,945

(22) Filed: May 3, 2002

(65) Prior Publication Data

US 2003/0205904 A1 Nov. 6, 2003

(51) Int. Cl.
*E05B 15/02* (2006.01)

(52) U.S. Cl. ..... 292/340; 292/341; 292/341.14; 292/DIG. 64

(58) Field of Classification Search ..... 292/340, 292/341, 341.11, 341.12, 341.13, 341.14, 292/341.15, 341.16, 341.17, 341.18, 341.19, 292/201, 216, DIG. 23, 299, DIG. 64
See application file for complete search history.

(56) References Cited

U.S. PATENT DOCUMENTS 1,690,408 A * 11/1928 Hasenflue ..... 292/340
2,706,316 A * 4/1955 Jones et al. ..... 52/582.2
2,706,317 A * 4/1955 Whittlesey ..... 52/582.2
2,721,753 A * 10/1955 Loeb ..... 292/341.15
2,721,754 A * 10/1955 Loeb ..... 292/341.15
2,775,799 A * 1/1957 Friedrich ..... 52/582.2
2,795,947 A * 6/1957 Peras ..... 70/141
2,956,829 A * 10/1960 Gerth ..... 292/341.15
2,957,721 A * 10/1960 Sklaw et al. ..... 292/341.15
3,179,458 A * 4/1965 Sconzo ..... 292/341.15
3,321,226 A * 5/1967 De Claire et al. ..... 292/65
3,680,902 A * 8/1972 Slattery ..... 292/341.14
4,045,064 A * 8/1977 Okada ..... 292/125
4,220,364 A * 9/1980 Poe ..... 292/341.18
4,438,963 A * 3/1984 Friedrich ..... 292/168
4,447,080 A * 5/1984 Hemmer ..... 292/264
4,470,626 A * 9/1984 Gergoe et al. ..... 292/341.12
4,691,952 A * 9/1987 Harmon ..... 292/341.18
4,883,298 A * 11/1989 Kleefeldt ..... 292/341.12
4,911,488 A 3/1990 Brackmann et al.
4,961,601 A * 10/1990 Lindholm et al. ..... 292/216
4,998,759 A 3/1991 Peterson et al.
5,125,698 A 6/1992 Thau
5,215,342 A * 6/1993 Yuge et al. ..... 292/340
5,234,238 A * 8/1993 Takimoto ..... 292/216
5,263,752 A 11/1993 Phail-Fausey et al.
5,342,103 A * 8/1994 Tame et al. ..... 292/341.17
5,382,062 A 1/1995 Kostler
5,501,495 A 3/1996 Claucherty
5,529,356 A 6/1996 Cetnar
5,707,092 A * 1/1998 Van Slembrouck et al. ..... 292/341.19

(Continued)

FOREIGN PATENT DOCUMENTS

DE 2002289 * 10/1971

(Continued)

*Primary Examiner*—Brian E. Glessner
*Assistant Examiner*—Carlos Lugo
(74) *Attorney, Agent, or Firm*—Robert H. Earp, III; McDonald Hopkins Co., LPA

(57) ABSTRACT

A striker assembly for latch engagement has a striker piece and a striker mount which encapsulates a portion of the striker piece to secure and mount the striker piece on a structure for engagement with a latch. In one embodiment, the striker mount is formed by a pair of cooperating base pieces which include a mounting plate and a striker plate. The base pieces form a striker-receiving cavity for encapsulating a portion of the striker. Alternate forms of striker pieces and striker mounts are also described and claimed.

21 Claims, 5 Drawing Sheets

U.S. PATENT DOCUMENTS

| | | | | | |
|---|---|---|---|---|---|
| 5,716,085 | A | | 2/1998 | Kobayashi | |
| 5,833,024 | A | * | 11/1998 | Kaneko | 180/69.2 |
| 5,927,774 | A | | 7/1999 | Granger | |
| 6,000,737 | A | * | 12/1999 | Yiu | 292/340 |
| 6,073,980 | A | | 6/2000 | Arabia, Jr. et al. | |
| 6,095,576 | A | | 8/2000 | Burton | |
| 6,095,577 | A | | 8/2000 | Nolzen | |
| 6,106,037 | A | | 8/2000 | Burton | |
| 6,108,894 | A | * | 8/2000 | Mizuki et al. | 29/509 |
| 6,155,616 | A | * | 12/2000 | Akright | 292/207 |
| D442,907 | S | * | 5/2001 | Santelman | D12/223 |
| 6,227,019 | B1 | * | 5/2001 | Chhatwal | 70/93 |
| 6,273,480 | B1 | * | 8/2001 | Burton | 292/340 |
| 6,616,204 | B1 | * | 9/2003 | Mitts et al. | 292/341.18 |
| 6,692,046 | B1 | * | 2/2004 | Paskonis | 292/340 |
| 6,715,808 | B1 | * | 4/2004 | Oxley et al. | 292/341.16 |

FOREIGN PATENT DOCUMENTS

| | | | | |
|---|---|---|---|---|
| EP | 667.433 | | | 5/1998 |
| JP | 01223276 | A | * | 9/1989 |
| JP | 02279884 | A | * | 11/1990 |
| JP | 03137373 | A | * | 6/1991 |
| WO | WO 00/75016 | A1 | | 12/2000 |

* cited by examiner

ENCAPSULATED STRIKER ASSEMBLY

FIELD OF THE INVENTION

This invention relates generally to latch strikers and striker assemblies used in connection with latch and closure mechanisms.

BACKGROUND OF THE INVENTION

The present invention relates to a retained or encapsulated striker assembly which can be used in connection with different types of latching mechanisms, such as seat latching mechanisms, door latching mechanisms, and other such applications in motor vehicles, aircraft or any type of compartment doors or closures. In the most basic form, the striker serves as an engagement structure, most typically in the form of rigid pin or bar, about which the pawl of a latch mechanism engages to secure a device (such as hinged door or panel) in a latched position. In many such installations, the striker is a fixture attached to a stationary framework and thereby permanently positioned to receive the latch. Furthermore, the striker is most commonly a single piece fixture, such as a steel pin, with a rigid mount such as described for example in U.S. Pat. Nos. 4,911,488; 4,998,759 and 6,095,576. By necessity the striker must be an integrated structure of substantial strength, with fairly close-tolerance dimensions for proper interface with a latch. One drawback of these design requirements is that the striker tends to be application specific, and the cost of design changes thereby increased.

In most vehicle door latching arrangements, the latch is mounted on a door, and the striker mounted on the corresponding door post. The latch has a fishmouth opening aligned with a striker pin. The striker pin is engaged by a latch pawl which rotates to a latched position. The latch pawl is held in the latched position by a trip arm that is released by a door handle or other mechanical lever.

In certain applications, forces are applied to the striker along multiple vectors, while the mounting of the striker pin (as the central load-bearing component) is optimized along the travel path of the latch. Such striker design may not be adequate to resist striker failure under the high random loads encountered in crashes and collisions. A need therefore exists for an improved striker design which is not limited to particular configuration or size for interface with a single type of latch, and which has an integrated construction which can withstand both expected loads in the direction of latch operation, and under random high loads of crashes or collisions.

Additional objects, advantages and novel features of the invention will be set forth in part in the description which follows, and in part will become apparent to those skilled in the art upon examination of the following or may be learned by practice of the invention. The objects and advantages of the invention may be realized and attained by various structures as covered by the patent claims.

SUMMARY OF THE INVENTION

In accordance with the present invention, there is a provided an encapsulated striker assembly which includes a separate striker held within a mount formed by a pair of symmetrically base pieces which form a mounting structure about the striker. The mounting plate is configured for mounting the striker assembly to a structure such as a door frame or jamb. Interior facing edges of the striker plates are placed in surface to surface contact and form an opening for receiving and retaining a portion of the striker. The striker is formed from a single piece of stamped or forged steel, and has a striker bar and a latch pawl receiving opening. The striker is secured within the opening in the striker mounting plates opening by a projection on an internal surface of at least one of the mounting plates which fits within a recess on a surface of the striker. Welds or brazing may be provided at the interface of an edge of one or both of the striker mounts and the striker. The striker may also be secured within the opening in the striker mounting plates by recesses in the plates, allowing the fit of formed projections or bosses on the striker. The striker may also be retained in the mounting plates by any suitable mechanical attachment or fastener, such as rivet, welds, brazing or adhesive medium.

In various alternate embodiments of the invention, the configurations of the striker mounts is altered to accommodate mounting of the striker in different locations and orientations on different support structures, while the striker-receiving opening formed by the mounts remains the same, thereby requiring no modification of the striker in these different applications.

In another embodiment of the striker assembly the striker mounts are provided with gusseted back plates which span between edges of orthogonal plates, further reinforcing the mounts and creating a reinforcing back wall with overslam and anti-jam protection against the latch, or otherwise increasing the footprint of the mount for various installation geometry.

Among the benefits and improvements that have been disclosed, other objects and advantages of this invention will become apparent from the following description made with reference to the accompanying drawings. The drawings constitute a part of this specification and include exemplary embodiments, and illustrate various objects, features, attributes and mechanical advantages of the invention.

DESCRIPTION OF THE FIGURES

The drawings illustrate the best mode presently contemplated of carrying out the invention.

DETAILED DESCRIPTION OF PREFERRED AND ALTERNATE EMBODIMENTS

Figure 1:
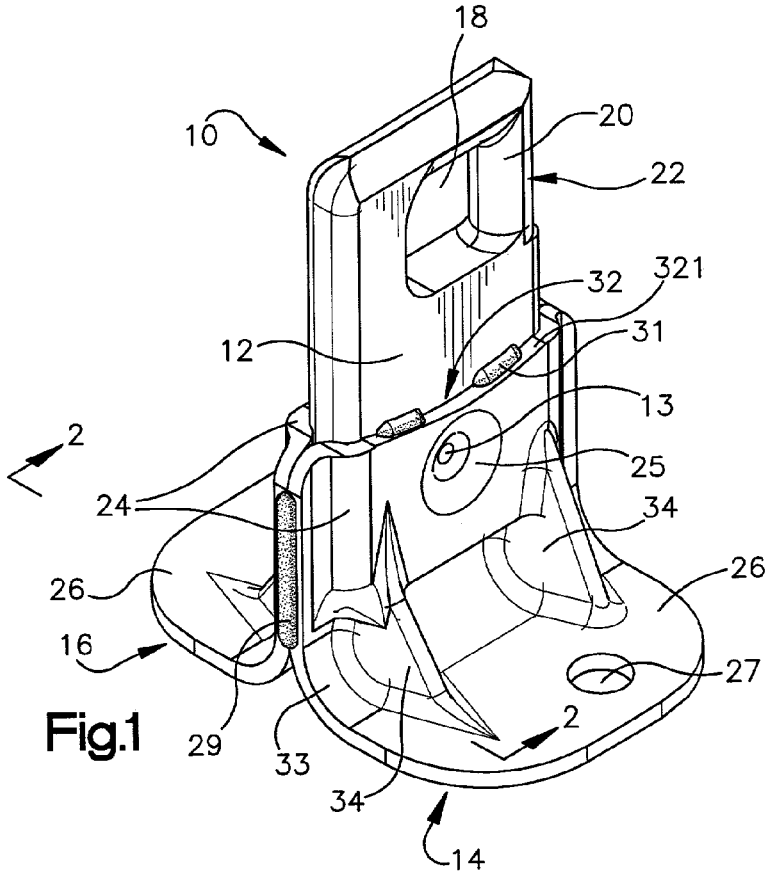
FIG. 1 is a perspective view of an encapsulated striker assembly of the present invention.
Figure 2:
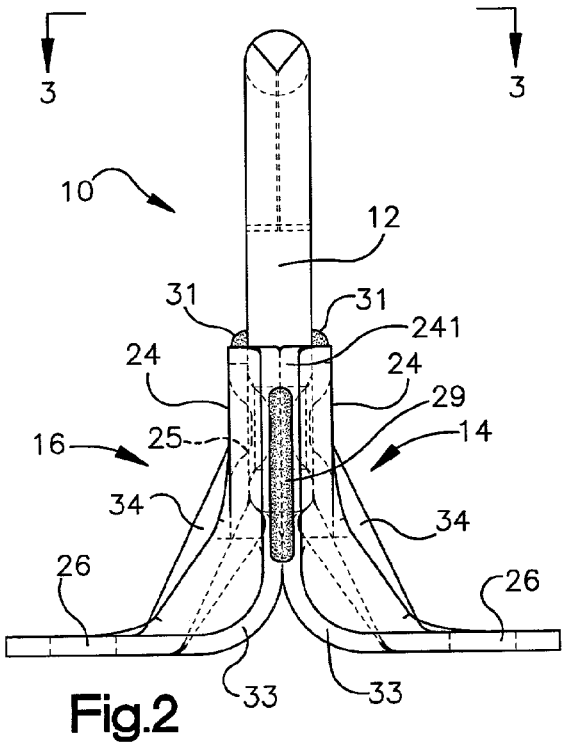
FIG. 2 is an elevation of the striker assembly of the present invention.

Referring to FIGS. 1–4, a latch striker assembly embodying the principles of the present invention is designated in its entirety at 10. The striker assembly 10 is designed to operate in cooperation with any suitable latch mechanism (not shown), of the type having a latch pawl accessible through an opening in a latch housing, the pawl being rotatably mounted to engage about a portion of the striker. As used herein, the term "striker" refers both generally to the piece or pieces which engage with a latch mechanism, and alternatively to the exact piece (also referred to as a "striker bar") with which a latch engages. The term "striker assembly" refers to the cooperating components of a striker piece and at least one striker mounting piece, and in a preferred embodiment two striker mounting pieces, which are mechanically attached or combined with the striker piece to create an engagement structure for a latch.

A mounting structure of the striker assembly 10 is formed by multi-dimensional base pieces 14 and 16, in this embodiment in a generally opposed arrangement, and fixedly secured together as further described. Base pieces 14 and 16 are each preferably formed as individual steel stampings, contoured along lines 33, to generally form two intersecting plates 24 and 26, referred to herein as the encapsulation plate 24 and the mounting plate 26 present in one or both of the base pieces 14, 16. Although identified separately as plates 24, 26, they are preferably integrally formed as a single continuous piece of material such as stamped steel which is contoured (along contour 33 and elsewhere) to form the unibody base pieces 14, 16. The striker base pieces 14, 16 may be formed of steel or aluminum of various alloy stampings, castings or forgings or plastic composites with sufficient strength to retain the striker and withstand the applied forces. The intersection of plates 24 and 26 (along contour 33) is substantially reinforced by gussets 34 (also preferably integrally formed from the homogenous piece of material of which the plates 24, 26 are formed) which span generally diagonally between the planar surfaces of the plates, and may be integrally formed for example in a stamping formation process. Plate 26 is alternatively referred to as the mounting plate. Plate 24 is alternatively referred to as the striker encapsulation plate. The base pieces 14 and 16 are in a generally opposed arrangement so that the striker encapsulation plates 24 are positioned back-to-back, forming an opening or cavity 32 therebetween for receiving and retaining a portion of the striker 12, as further described. The striker assembly 10, including the base pieces 14 and 16 in combination with the striker 12 may be structurally integrated by welds 29 located for example along edges 241 of the striker encapsulation plates 24. In this manner, the base pieces 14 and 16 are effectively formed as a single unibody structure or striker mount which encapsulates a portion of the striker, to secure the striker in a position for engagement with a latch. Welds 31 may be formed at the interface of the striker 12 with the edges 321 of the striker encapsulation plates 24 about the striker opening 32 to further secure the striker within the base pieces/striker mount and structurally unify the striker assembly.

Figure 5A:
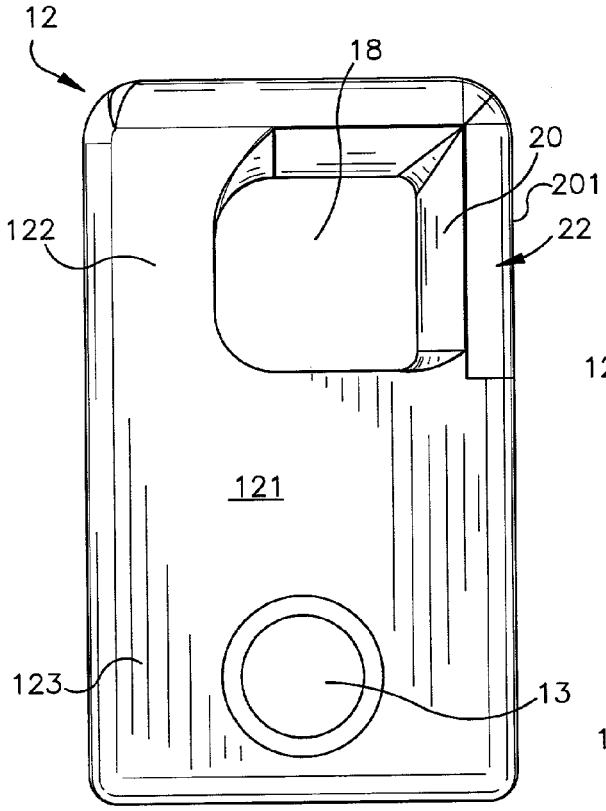
FIG. 5A is a side view of the striker of the striker assembly of the invention.
Figure 5B:
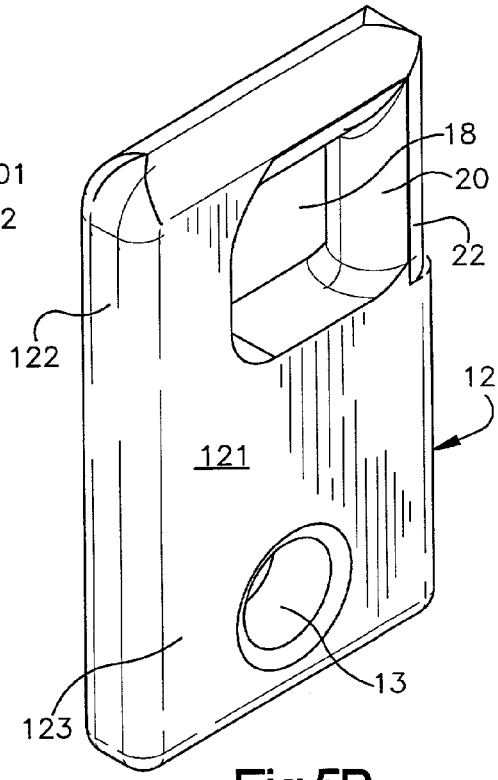
FIG. 5B is a perspective view of a striker of a striker assembly of the invention.

Referring now to FIGS. 5A and 5B, the striker 12 is preferably formed as a unibody component, such as a stamped or forged single piece in a slab or planar form, with a body 121, and a latch-receiving opening 18 located within the body between upper 122 and lower 123 portions. A striker bar 20 spans the latch-receiving opening 18 at an edge of the body 121, extending between upper and lower portions 122, 123. In a preferred embodiment and related method of manufacture, the unibody striker 12 is formed in a sequential cutting and stamping operation wherein the formation of the latch-receiving opening 18 also forms the striker bar 20 and the latch contact surface 22 thereof, the outer edge 201 of which may be chamfered, contoured or otherwise rounded to facilitate the rotational engagement with a latch pawl of a cooperating latch assembly. The striker bar 20 can be straight as shown, or curvilinear, such as arcing outward or inward relative to the plates, to optimize mating with any particular latch design.

As a principle of the invention, the size and shape of the striker bar 20 and opening 18 can be modified without changing the lower potion 123 or the base pieces 14, 16. The striker 12 is shown in the particular planar and rectangular form. Encapsulated strikers of other configurations are also within the scope of the claimed invention, as are strikers having different shaped latch-receiving openings and striker bars. Any striker which is configured for capture or encapsulation within a cooperating mounting structure is within the scope of the claimed invention.

Figure 5C:
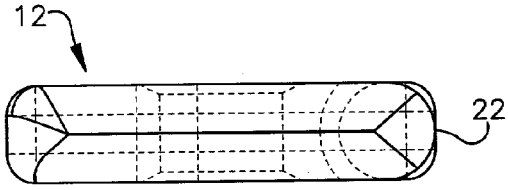
FIG. 5C is an end view of a striker of a striker assembly of the present invention.

Additionally, as illustrated in FIGS. 5A–5C, the striker 12 also includes a recess or depression 13 located on a planar surface of the lower portion 123. As shown in FIGS. 1–4, one or both of the striker plates 24 include a correspondingly located protrusion 25 which engages with the recess 13. The protrusion 25 secures the striker 12 within the opening 32 between the mount plates 24 of the base pieces 14, 16. This type of position registration and securement of the striker 12 relative to the base pieces 14, 16 can be alternatively configured with the cooperating depression/recess 13 and protrusion 25 located and/or repeated in different areas of the interface of the striker, for example anywhere in the lower portion 123 of the striker, with the striker encapsulation plates 24 of the base pieces 14, 16. The upper portion 122 of the striker 12 which is not encapsulated by the striker encapsulation plates 24 can be freely configured and contoured for any particular application or installation.

Figure 3:
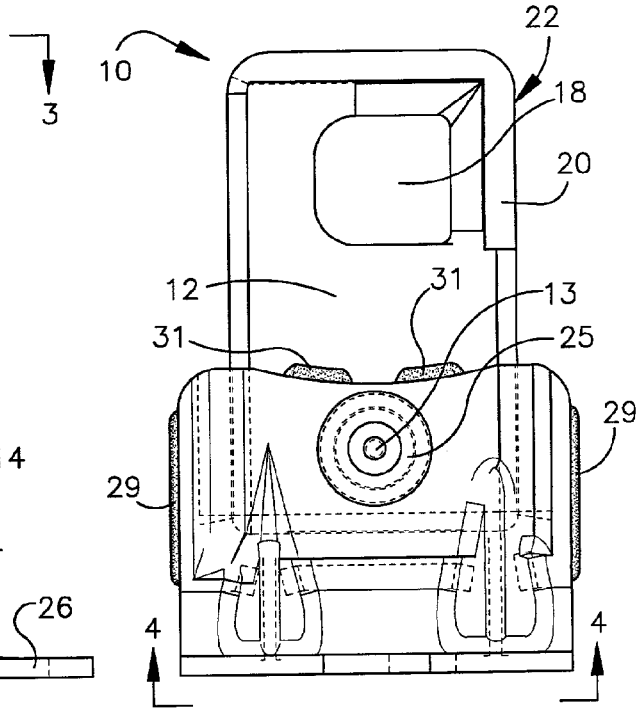
FIG. 3 is a top view of the striker assembly of the present invention.
Figure 4:
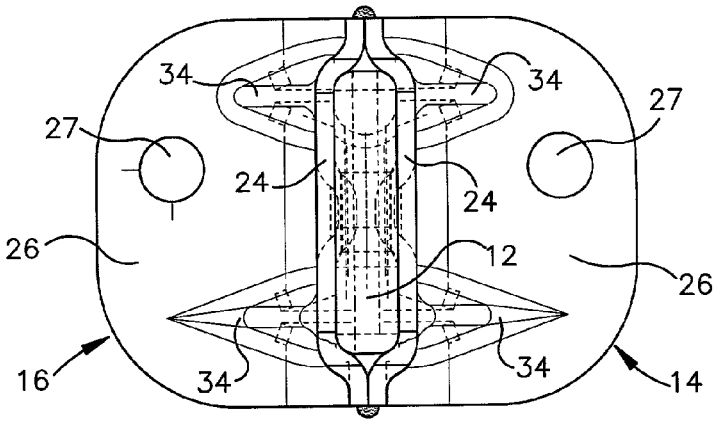
FIG. 4 is a side view of the striker assembly of the present invention.

As best shown in FIGS. 1 and 3, one or more fastener openings 27 are located in the mounting plates 26 to receive a fastener therethrough for attachment of the striker assembly to a supporting structure. The striker assembly 10 is mounted to orient the striker bar 20 to face the opening of the latch mechanism housing. The mounting plates 26 can be alternatively configured for mounting on any type of surface without modification of the striker 12 or the cooperating latch. For example, the width and length of the mounting plates 26 need not match the striker encapsulation plates 24. The base pieces 14, 16 may be formed to align with angles or contours of frames or other structures to which they are attached. Also, the location of the reinforcing gussets 34 may be altered according to mounting parameters and/or forces applied to the striker.

The invention is further adaptable to installations wherein a structural component of the object to which the striker assembly is mounted serves as one or both of the base pieces 14, 16. For example, a wall surface can be configured similar to one of the striker encapsulation plates 24 to receive the striker piece, with the other striker encapsulation plate then attaching to the wall to encapsulate the striker piece.

Figure 6A:
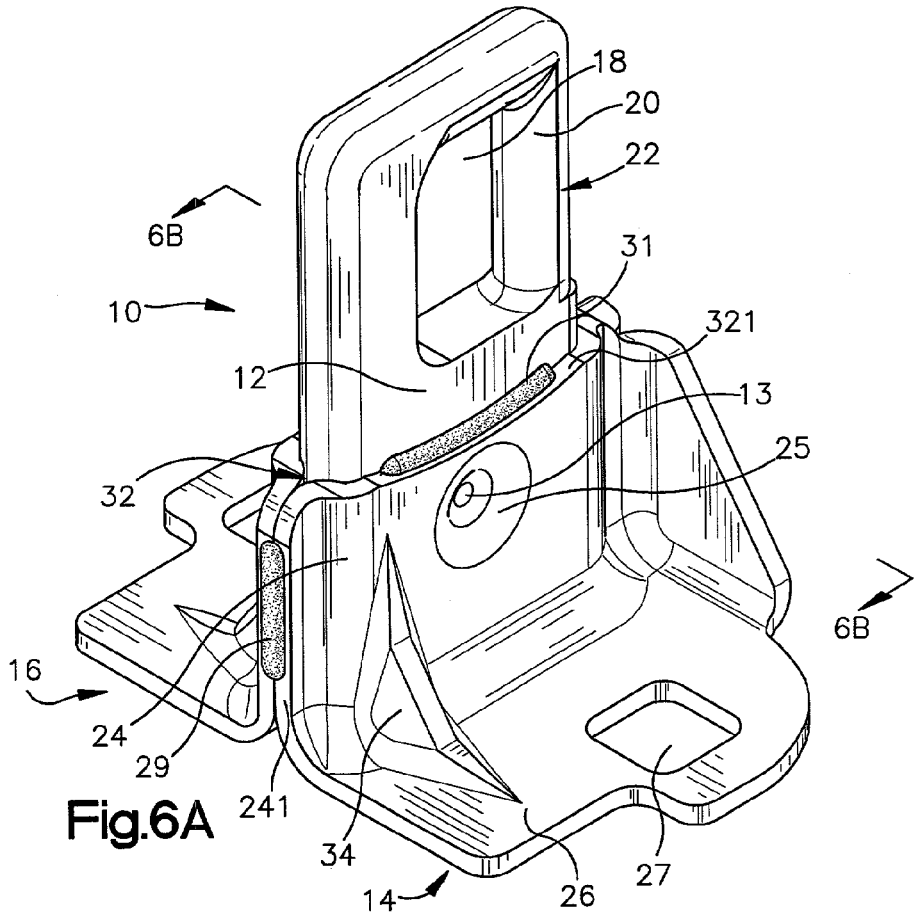
FIG. 6A is a perspective view of an alternate embodiment of a striker assembly of the present invention.
Figure 6B:
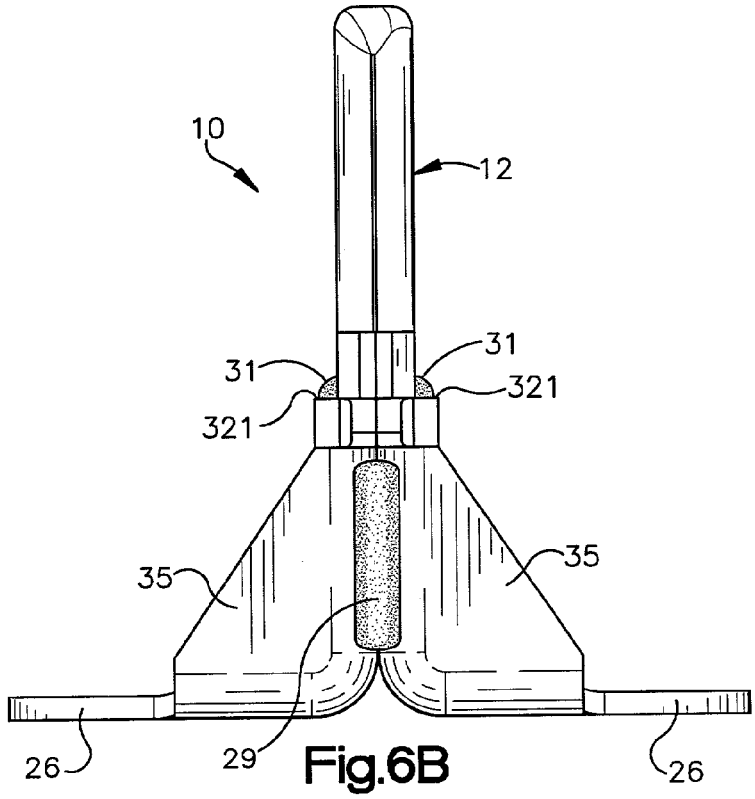
FIG. 6B is an elevation of the striker assembly of FIG. 6A.

FIGS. 6A and 6B illustrate an alternate embodiment of the striker assembly 10. In this embodiment, the mounting plates 26, of the base pieces 14, 16 are somewhat enlarged and extend at least to the forward edge of the striker 12 generally aligned or parallel with the striker bar 20. A wall 35 is formed in a third plane, intersecting the mounting plate 26 and striker encapsulation plate 24, and located either at the forward edge of the striker or opposite the striker bar 20, according to anticipated loads on the striker assembly. Wall 35 can be integrally formed with mounting plate 26 and encapsulation plate 24 as a single stamping, and secured into the orthogonal intersecting position by one or more welds along the lines of intersection. Under the forces of a crash, the striker bar 20 may move further into the latch mechanism closing the gap or the striker 12 may be "consumed" by the latch mechanism, making disengagement much more difficult. Therefore, the wall 35, in addition to substantially strengthening the entire striker assembly 10 (in a manner similar to gusset 34), limits this convergence and consumption to the extent of any gap or spacing between the latch housing and wall 35. The wall 35 substantially increases the latch strength and crash tolerance of the latch/striker combination, making disengagement of the latch from the striker 12 under abnormal loads more likely. When located opposite the striker bar 20, the wall 35 may also serve as a mechanically cooperating member with a latch, latch housing or latch mounting structure, wherein the wall interfaces with the latch or latch mount, or otherwise serves as slam or overslam protection against the latch housing which may otherwise extend past the striker when the door or seat is slammed with excessive force. The location of the wall 35 at lateral edges of the plates 24, 26 can be in place of a reinforcing gusset 34, or in combination with a gusset 34 spaced from wall 35, as shown in FIG. 6A.

Figure 7A:
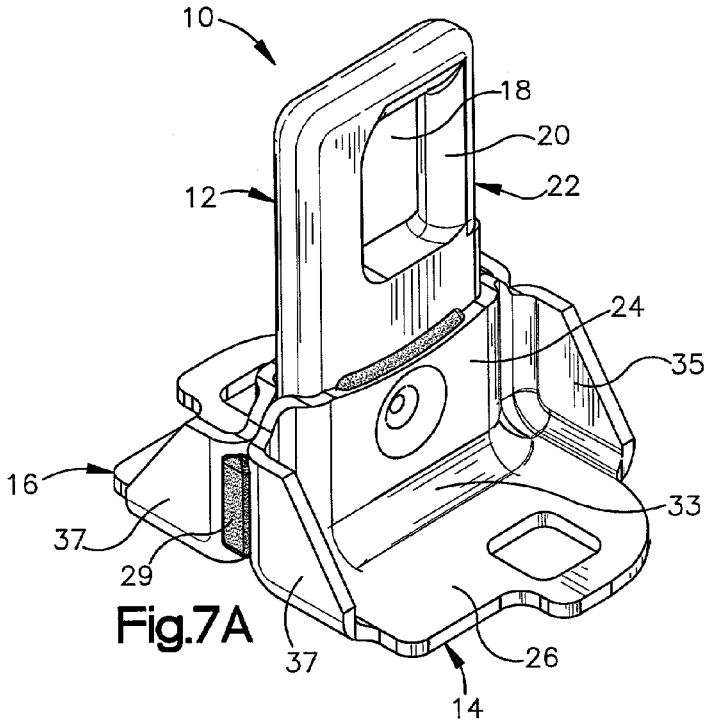
FIG. 7A is a perspective view of an alternate embodiment of an encapsulated striker assembly of the present invention.
Figure 7B:
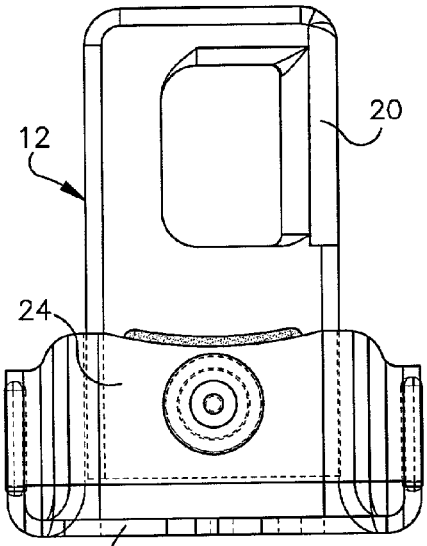
FIGS. 7B and 7C are elevations of the encapsulated striker assembly of FIG. 7A.
Figure 7C:
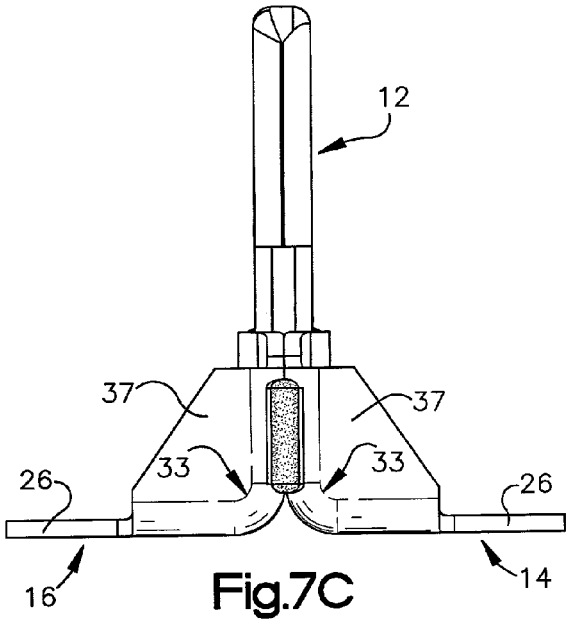

FIGS. 7A–7C illustrate another alternate embodiment of an encapsulated striker assembly of the invention, wherein an additional intersecting wall 37 is formed at an opposite lateral edge of plates 24, 26, generally opposed to wall 35. In this embodiment, gussets 34 are dispensed with in favor of the dual function of walls 35 and 37 of strengthening the structure of the intersection of plates 24 and 26, and providing additional mounting surfaces for the base pieces 12, 14 relative to any structure on which the striker assembly 10 is mounted. A reinforcement weld 29 can be placed between the striker encapsulation plates 24 and walls 37 as shown in FIG. 7A.

Figure 8A:
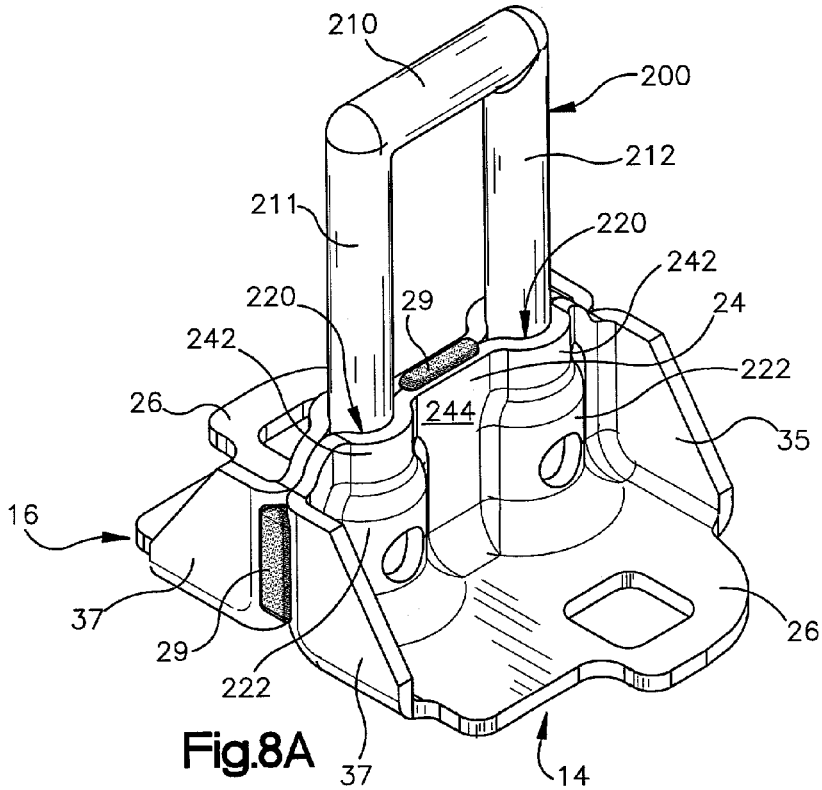
FIG. 8A is a perspective view of an alternate embodiment of an encapsulated striker assembly of the present invention.
Figure 8B:
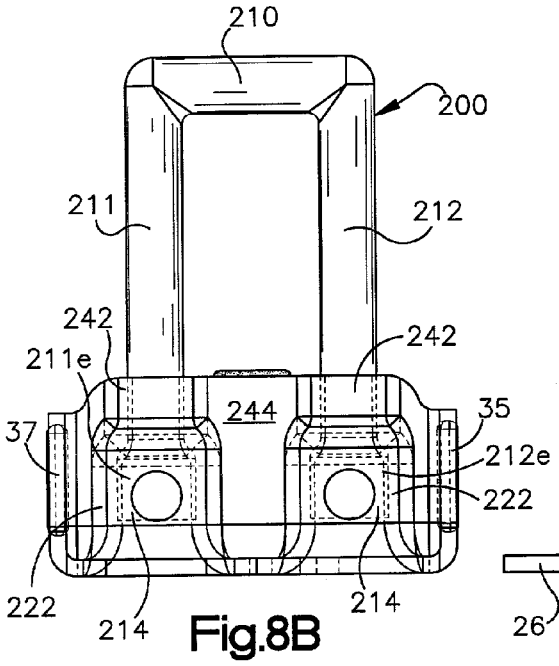
FIGS. 8B and 8C are elevations of the encapsulated striker assembly of FIG. 8A.
Figure 8C:
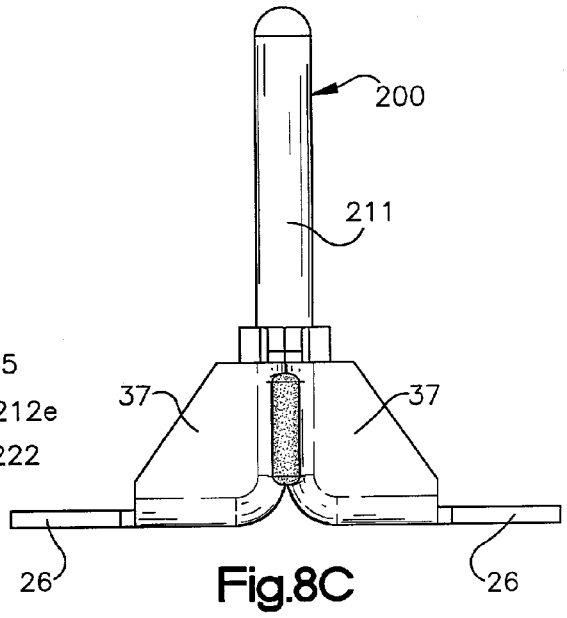

FIGS. 8A–8C illustrate another alternate embodiment of an encapsulated striker assembly of the invention, having a similar three part assembly with cooperating base pieces 14 and 16 which encapsulate a single piece striker 200. The striker encapsulation plates 24 are alternatively configured according to the lower portion of the striker 200. The striker 200 is in a wire form, having a striker bar 210 which spans between legs 211 and 212. Distal ends 211*e* and 212*e* of legs 211, 212 are received within separate openings or cavities 220 formed by contours 222 in the striker encapsulation plates 24. The distal ends 211*e* and 212*e* may be formed with flared heads 214, as shown in FIG. 8B, which fit within corresponding cavities formed between the striker encapsulation plates 24. Upper regions 242 of the encapsulation plates 24 about the openings 220 are necked down to further encapsulate each distal end 211*e*, 212*e* of the striker legs 211, 212 against axial withdrawal from the mount formed by the base pieces 14, 16. A center region 244 of the encapsulation plates 24 is substantially planar and flush against the opposing plate, allowing a seam weld 29 to be placed between the legs 211, 212 of the striker 200. Walls 35 and 37 can be optionally formed in the base pieces 14, 16 of this alternate embodiment.

Although the invention has been shown and described with respect to a certain preferred and alternate embodiments, equivalent alterations and modifications which may occur to others skilled in the art upon the reading and understanding of this specification are also within the scope of the invention as defined by the claims. For example, the invention is not limited to the generally orthogonal arrangement of the intersecting plates of the striker base pieces, and one or both of the base pieces may be integrally formed with another part of a machine or vehicle. Other forms of interconnection between the intersecting plates may be employed to provide a retained striker plate assembly. And striker pieces of different forms, yet having a latch-engaging striker bar, may be similarly encapsulated by base pieces. The present invention includes all such equivalent variations, alterations and modifications of the inventive principles, as defined by the claims and equivalents.

What is claimed is:

1. A striker assembly for a vehicle latching mechanism, the striker assembly comprising:

a striker;

two striker base pieces, each striker base piece having:

a striker encapsulation plate, and a mounting plate which extends from the striker encapsulation plate, the striker assembly formed by encapsulation of the striker within the striker encapsulation plates of the striker base pieces, and wherein at least one of the striker encapsulation plates has an offset dimensioned to engage with a portion of the striker.

2. The striker assembly of claim 1 wherein the mounting plate is in a different plane than the striker encapsulation plate.

3. The striker assembly of claim 1 wherein at least one of the base pieces further comprises a gusset between the mounting plate and the striker encapsulation plate.

4. The striker assembly of claim 1 wherein the striker encapsulation plates are contoured to form a striker receiving cavity.

5. The striker assembly of claim 1 further comprising at least one weld between the base pieces.

6. The striker assembly of claim 1 further comprising at least one weld at an interface of at least one of the base pieces with the striker.

7. The striker assembly of claim 1 wherein the striker has a thickness dimension substantially greater than a thickness dimension of the plates of the base pieces.

8. The striker assembly of claim 1 wherein the striker is generally rectangular, and the striker bar is generally aligned with an edge of the striker.

9. The striker assembly of claim 1 wherein the striker is a wire form striker, with a portion of the wire form encapsulated by the striker encapsulation plates.

10. The striker assembly of claim 1 wherein at least one of the base pieces further comprises a wall spanning between the mounting plate and the striker encapsulation plate.

11. The striker assembly of claim 1 wherein at least one of the base pieces further comprises at least two walls spanning between the striker encapsulation plate and the mounting plate.

12. A striker assembly for a vehicle latching mechanism, the striker assembly comprising:

a striker two striker base pieces, each striker base piece having:

a striker encapsulation plate, and a mounting plate which extends from the striker encapsulation plate, the striker assembly formed by encapsulation of the striker within the striker encapsulation plates of the striker base pieces, and wherein the striker has a recess which corresponds with a protrusion on the striker encapsulation plate of one of the base pieces.

13. A striker assembly for a vehicle latching mechanism, the striker assembly comprising:

a striker;

two striker base pieces, each striker base piece having:

a striker encapsulation plate, and a mounting plate which extends from the striker encapsulation plate, the striker assembly formed by encapsulation of the striker within the striker encapsulation plates of the striker base pieces, and wherein the striker has a lower portion configured to be encapsulated by the striker encapsulation plates, and an upper portion contiguous with the lower portion, the upper portion further comprising a striker bar and a latch-receiving opening proximate to the striker bar.

14. A striker assembly for engagement with a latch mechanism, the striker assembly comprising:

a striker having a body, a striker bar, and a latch receiving opening proximate to the striker bar;

first and second base pieces configured to cooperatively engage with the striker, each base piece having a striker encapsulation plate configured to encapsulate at least a portion of the striker, the striker encapsulation plates of the base pieces being positioned on opposing sides of the striker to thereby encapsulate at least a portion of the striker, and wherein at least one of the striker encapsulation plates contains a protrusion which fits within a depression in a surface of the striker.

15. The striker assembly of claim 14 further comprising at least one weld between an edge of one of the striker encapsulation plates and the striker.

16. The striker assembly of claim 14 further comprising at least one weld between the base pieces.

17. The striker assembly of claim 14 wherein a base piece further comprises a gusset between a striker encapsulation plate and a mounting plate.

18. The striker assembly of claim 14 wherein at least one of the base pieces further comprises a reinforcing wall which extends from the striker encapsulation plate.

19. The striker assembly of claim 14 further comprising at least one weld between an edge of a striker encapsulation plate and the striker.

20. The striker assembly of claim 14 wherein the striker is a wire form, wherein a portion of the wire form striker is encapsulated by the base pieces.

21. A striker assembly for engagement with a latch mechanism, the striker assembly comprising:

a striker having a body, a striker bar, and a latch receiving opening proximate to the striker bar;

first and second base pieces configured to cooperatively engage with the striker, each base piece having a striker encapsulation plate configured to encapsulate at least a portion of the striker, the striker encapsulation plates of the base pieces being positioned on opposing sides of the striker to thereby encapsulate at least a portion of the striker, and wherein the striker is in a generally rectangular form, wherein a lower portion of the striker is encapsulated in a cavity formed between the striker encapsulation plates, and a striker bar is located in an upper portion.

* * * * *